US006421843B1

(12) United States Patent
Mellinger et al.

(10) Patent No.: US 6,421,843 B1
(45) Date of Patent: Jul. 23, 2002

(54) LOW WATER VOLUME TOILET

(75) Inventors: Melvyn Wayne Mellinger, Fort Lauderdale; Mark Wayne Mellinger, Pompano Beach; Paul C. Mellinger, Fort Lauderdale, all of FL (US)

(73) Assignee: Headhunter, Inc., Fort Lauderdale, FL (US)

( * ) Notice: Subject to any disclaimer, the term of this patent is extended or adjusted under 35 U.S.C. 154(b) by 0 days.

(21) Appl. No.: 09/785,964

(22) Filed: Feb. 16, 2001

(51) Int. Cl.[7] ..... E03D 9/10
(52) U.S. Cl. ..... 4/319; 4/407; 4/431
(58) Field of Search ..... 4/319, 320, 407, 4/431, 432

(56) References Cited

U.S. PATENT DOCUMENTS 3,732,579 A * 5/1973 Allander et al. ..... 4/431
4,734,943 A * 4/1988 Mellinger et al. ..... 4/319 X
5,036,554 A * 8/1991 Blount ..... 4/319 X
5,109,551 A * 5/1992 Lecat ..... 4/431

* cited by examiner

*Primary Examiner*—Robert M. Fetsuga
(74) *Attorney, Agent, or Firm*—Buskop Law Group, P.C.; Wendy Buskop

(57) ABSTRACT

A toilet and method for flushing using less than 1 gallon of water, comprising: a toilet body comprising a bowl, support walls, rim, and a waste outlet; a water jet macerator having a waste inlet connected to the waste outlet, a macerator water inlet connected to a second water stream and a discharge opening connected to a first discharge passageway; the toilet body further comprising a water inlet port for receiving water from a water source connected to an inlet valve; a splitter for dividing water from the inlet valve into a first water stream and a second water stream; a rim valve for receiving water from the first water stream; a bowl spud for receiving water from the rim valve; a rim adapted to receive water from the bowl spud; an actuator connected to the inlet valve which permits a user to initiate flushing by actuating the inlet valve causing water to flow to the splitter, a second water stream and a first water stream; a nozzle for receiving the second water stream and expelling water from the second water stream across the bowl into the discharge opening macerating the waste and moving macerated waste into the first discharge passageway; and an anti-siphon device connected to the first discharge passageway and to a second discharge passageway.

21 Claims, 7 Drawing Sheets

LOW WATER VOLUME TOILET

BACKGROUND OF THE INVENTION

1. Field of the Invention

This invention relates to a flush toilet, preferably, a marine toilet, adapted for high-pressure waste removal utilizing very little water, less than one gallon.

2. Background of the Invention

Water saving toilets have been needed in the desert areas of the world, and on moveable vessels, like aircraft, recreational vehicles, and boats. The marine industry has long needed reliable toilets, which conserve water. There has been a trend toward toilet bowl designs that achieve adequate flushing while minimizing the use of water. One example of a jet flush water supply system is disclosed in U.S. Pat. No. 5,502,945. This patent discloses a flush toilet that includes a toilet bowl and a trap drainage passage connected to the toilet bowl. The toilet bowl has a water jet hole defined in a bottom region thereof and opening toward the trap drainage passage. A source of pressurized water, such as from a water pump or similar pressurizing unit is coupled to the water jet hole for drawing water under lower pressure directly from an external water supply and expelling the water under higher pressure through the water jet hole toward the drainage passage to develop a siphon flow to discharge sewage from the toilet bowl through the trap drainage passage.

Additionally a water jet toilet has been descried in U.S. Pat. No. 5,983,413, which is incorporated by reference and includes a toilet bowl, with a discharge trap formed continuously at the bottom of the bowl part. The trap further has a rising channel that extends obliquely from the bottom of the bowl. A first weir is formed at the upper end of the rising channel. A descending channel extends downwardly from the first weir, and a cross laid channel extends substantially in the horizontal direction from the lower end forming the descending channel and the discharge opening. A gathered water part is formed between the second weir and the lower end of the descending channel, and simultaneously, the descending channel is formed in the vicinity of the lower end with a horizontal part extending horizontally toward the cross laid channel. This invention has been know to have difficulty in installation, and other operational problems because of valve body being disposed on a support arm which is known to fail.

The present invention differs from the applicant's own patent U.S. Pat. No. 4,578,831, in that the present invention uses less water and improved jet water maceration as compared with the original invention, Finally, various power flush toilets have been disclosed; see U.S. Pat. Nos. 6,029,287, 5,918,325 and 5,803,114. None of these references has the features of the present invention, which is a type of toilet that utilizes the energy available in the pressured water supplied to create a vacuum in the toilet bowl.

The present invention has been made taking the above-described problem in the prior arts into consideration and aims at providing a flush toilet, which can sufficiently cope with water saving requirements while providing a reliably operating toilet.

SUMMARY OF THE INVENTION

A toilet and method for flushing using less than 1 gallon of water, comprising: a toilet body comprising a bowl, support walls, a rim, and a waste outlet; a water jet macerator having a waste inlet connected to the waste outlet, a macerator water inlet connected to a second water stream and a discharge opening connected to a first discharge passageway; the toilet body further comprising a water inlet port for receiving water from a water source connected to an inlet valve; a splitter for dividing water from the inlet valve into a first water stream and a second water stream; A rim valve for receiving water from the first water stream; a bowl spud for receiving water from the rim valve; a rim adapted to receive waste from the bowl spud; an actuator connected to the inlet valve which permits a user to initiate flushing by actuating the inlet valve causing water to flow to the splitter, second water stream and the first water stream; a nozzle for receiving the second water stream and expelling water from the second water stream across the bowl into the discharge opening, macerating the waste and moving macerated waste into the first discharge passageway; and an anti-siphon device connected to the first discharge passageway and to a second discharge passageway.

DETAILED DESCRIPTION

Figure 1:
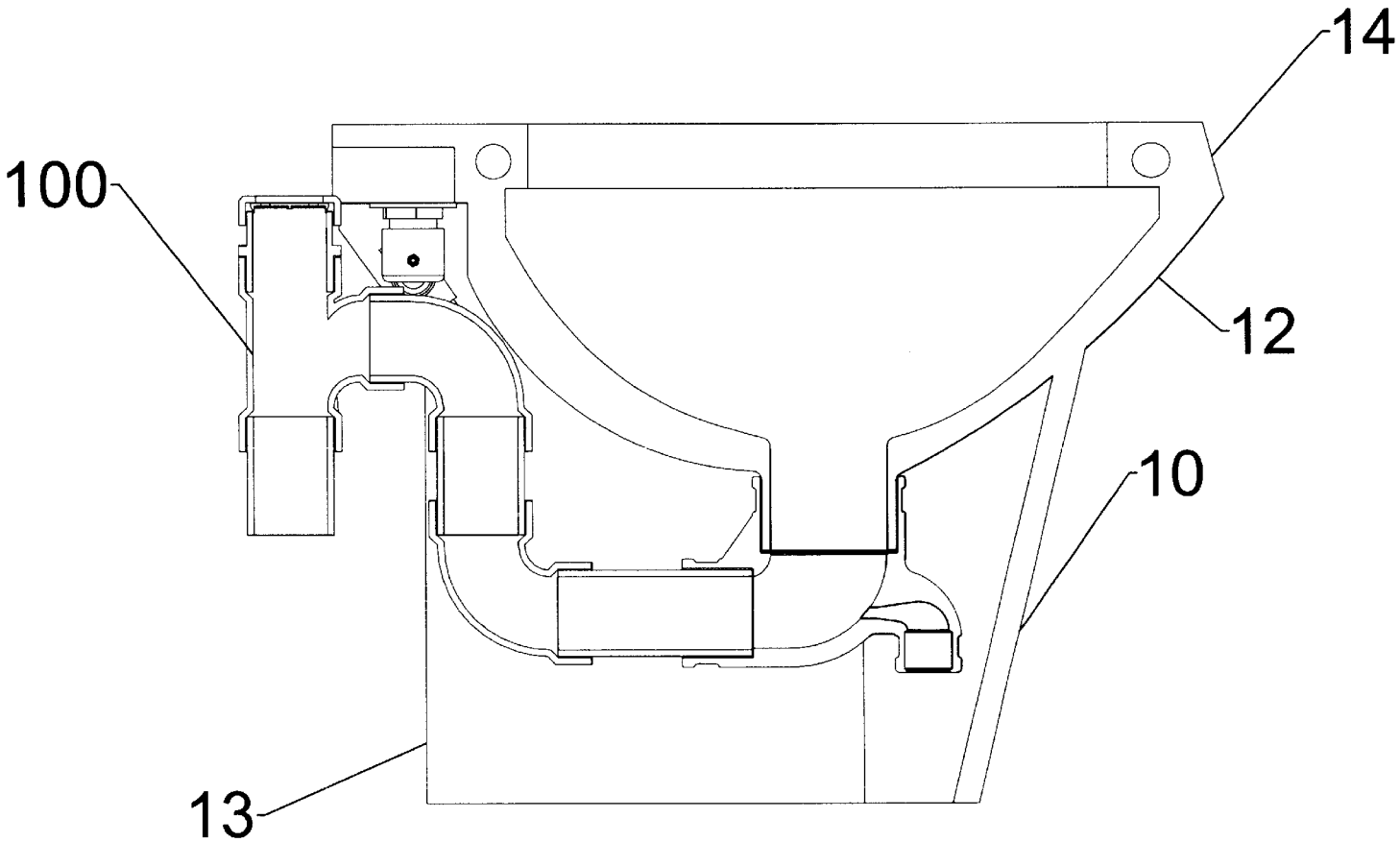
FIG. 1 is cross sectional view of the toilet assembly of the invention.

The present invention can be used in a variety of maritime end uses, including floating vessels, production platforms, including fixed production platforms, floating production platforms including deep draft cassion vessels (SPAR), tension leg platform (TLP), semisubmersible production vessels, or other floating vessels, such as tenders. It is also contemplated that the present invention be used on luxury yachts, such as powerboats having heads, and sailboats having heads (marine bathrooms) and on submarines. The invention can be used on residential and commercial buildings.

The invention relates to a unique toilet, which can be attached onto land based vessels, such as recreational vehicles with pressurized water supplies. Alternatively, it is within the scope of the present invention to use the unique jet water toilet for any land-based situation wherein a pressurized water supply is available. Optionally, this toilet can be used for aircraft.

The invention in one embodiment, involves a low water volume, less than one gallon of water, high velocity, between 8 and 16 gallons per minute and most preferably capable of macerating 12 gallons per minute, the sewage and directing it into a holding tank or through a seacock or into a sewage system. The invention relates to a toilet that has no moving parts that ever touch the waste, which results in fewer blockages and virtually no maintenance. The invention is for a toilet which adds only enough water to the waste stream to keep conditions aerobic, resulting in a clean and odor-free sanitation system. The present invention is designed to meet or exceed American National Standard's Institute test standard A-119.2.

There are various features of this toilet. Referring to FIG. 1 through 6, a toilet with a flush volume of less than 1 gallon, has a toilet body (10) comprising a bowl part (12), support walls, (13), a rim (14) (shown in FIG. 5) and a waste outlet (15). A water jet macerator (16) (shown in FIG. 3) has a waste inlet (18) is also connected to waste outlet (15) which extends from a location proximate the bottom of the bowl. A macerator water inlet (20) (shown in FIG. 3 and FIG. 5) is connected to a second water stream (40). A discharge opening (22) (shown in FIG. 3) connects to a first discharge passageway, (26) which is preferably sanitation piping (26). Sanitation piping, which can be used in this invention, includes plastic hose, PVC, metal, plastics, laminates, rubbers, composites, various crystalline polymers or even nylon. Preferred sanitation piping can be pipe, such as hard pipe or flexible coated hoses.

The toilet body, bowl, support walls, rim and water outlet port can be made of one-piece construction and most preferably is porcelain. It is also contemplated that these components can be separate parts, which can be glued or otherwise joined together. In still another embodiment, the components can be made from metal, plastic or composite material.

Figure 4:
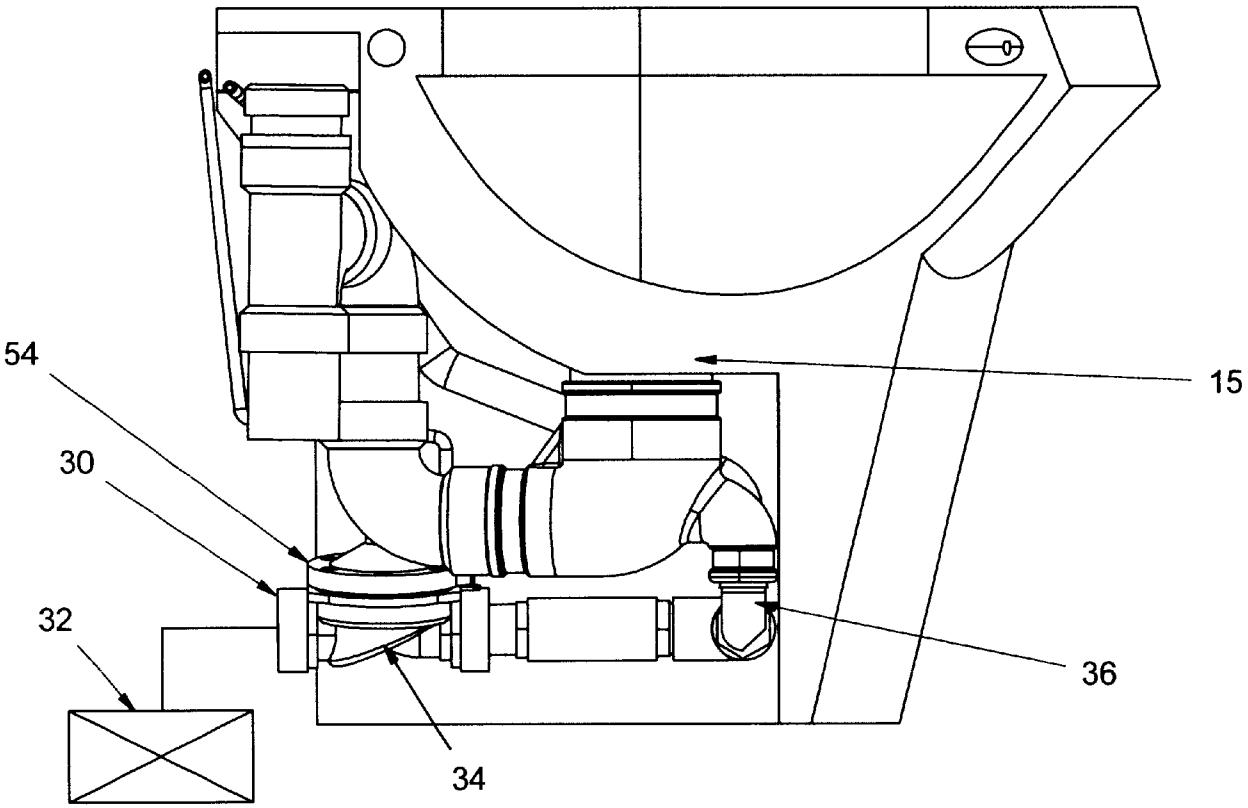
FIG. 4 shows a side view of the invention installed in a toilet body.

As shown in FIG. 4, the toilet body (10) further has a water inlet port (30) for receiving water from a water source (32). The water source can be pressurized water, such as from a pressurized tank, which adds psi through a pump, or it can be pressurized by having the tank elevated above the toilet. In a preferred embodiment, the pressure on the water in the system is at least 25 psi, which enables the system to have a flow rate of about 12 gallons per minute, and between 8 and 12 gallons per minute.

Water from the water source (32) flows to the inlet valve (34), which is preferably a diaphragm valve with a flow regulator. In the most preferred embodiment, the diaphragm valve flow regulator is a hole measuring 0.06 inches in diameter; however, various diameters of flow regulators can be used ranging from 0.01 to 0.12 inches.

In still another embodiment, the inlet valve can be a valve selected from the group including ball valves, piston valves, hydraulic valves and pinch valves.

Figure 2:
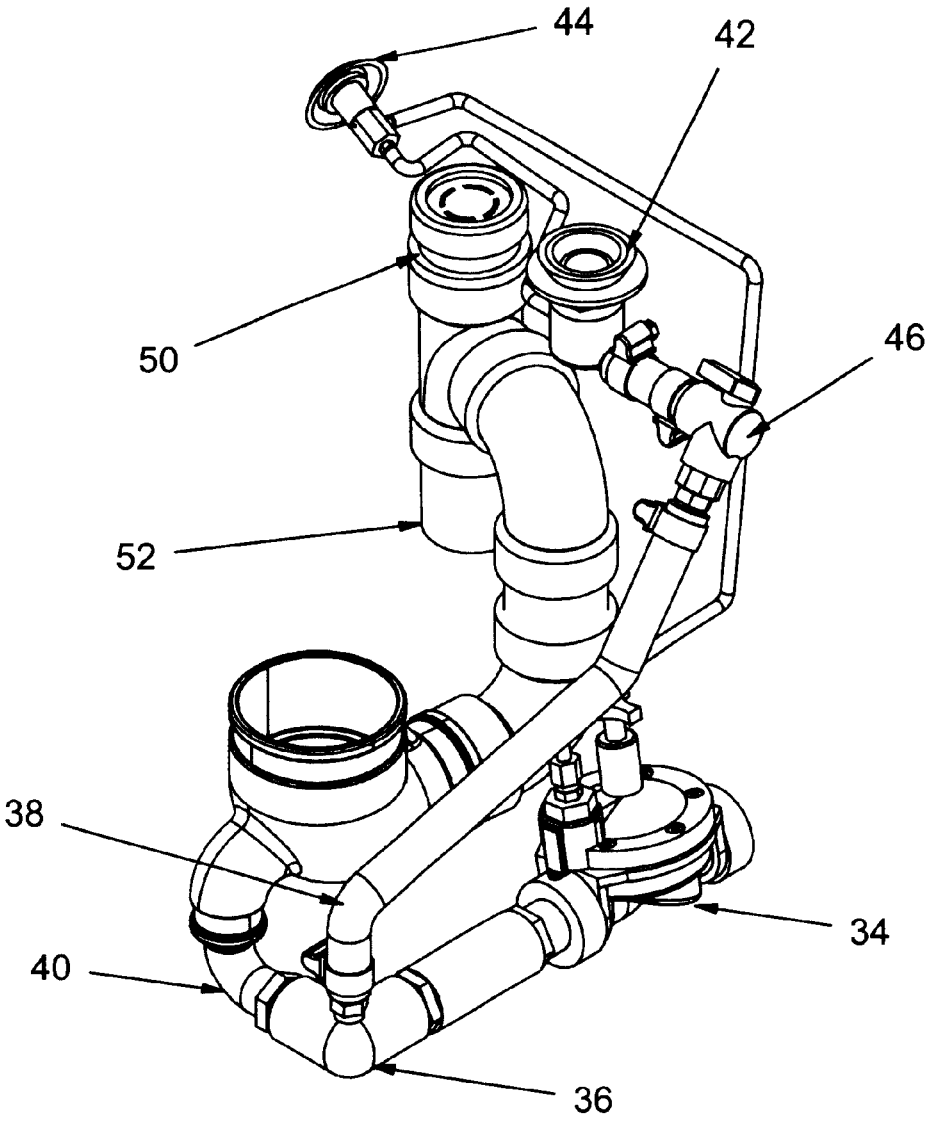
FIG. 2 shows an view of the internal flow path of the toilet assembly.
Figure 3:
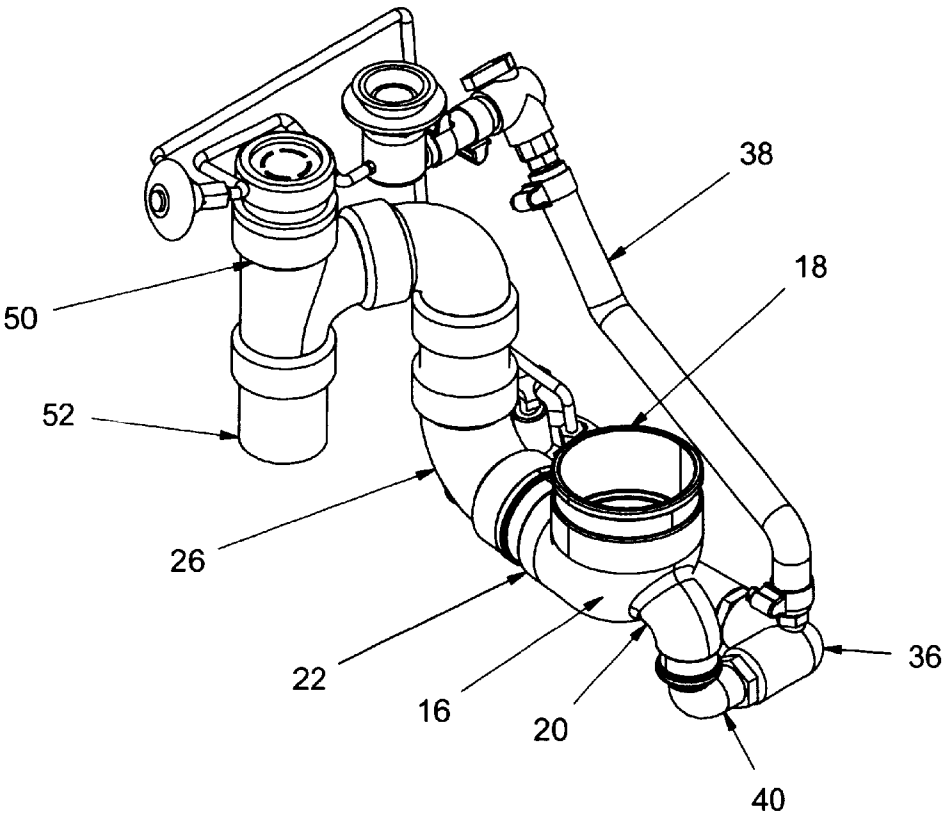
FIG. 3 is a detail of the vented loop embodiment of the invention.

FIG. 2 and FIG. 3 provide the detail that shows a splitter (36) used for dividing water from the inlet valve (34) into a first water stream (38) and a second water stream (40). A rim valve (46) receives water from first water stream (38). A bowl spud (40) shown in FIG. 2 and FIG. 5, receives water from rim valve (46). Rim (14) receives water from bowl spud [(40)] 42 to fill water into the toilet bowl.

FIG. 3 shows actuator (44). The actuator is connected to inlet valve (34) (shown in FIG. 2). Inlet valve (34) which permits a user to initiate flushing by actuating inlet valve (34) causing water to flow to splitter (36) second water stream (40) and first water stream 38. The actuator (44) can be a valve, which is a member of the group consisting of hydraulic valves, electric valves, pneumatic valves and mechanical valves. In the most preferred embodiment, the actuator is a hydraulic valve, which actuates the inlet valve (34). Rim valve 46 (shown in FIG. 2) can be used to control water flow to rim 14.

A nozzle (48), which is preferably a tapered nozzle, and is better shown in FIG. [7] 6 is adapted for receiving the second water stream (40) and expelling water from the second water stream across the bowl (12) into discharge opening (22), which is shown in FIG. 3. This nozzle and water stream combination, without any moving parts, act to macerate the toilet waste and move the waste into the first discharge passageway (26) which in the most preferred embodiment is sanitation piping. This nozzle can be tapered and have an inner diameter between ⅛ inch and ¾ inches. The discharge passageway (26) preferably has a diameter that ranges from 1.25 inches to 2.0 inches. It is contemplated that the nozzle will expel water at a rate between 8 and 16 gallons per minute in the most preferred embodiments.

Figure 5:
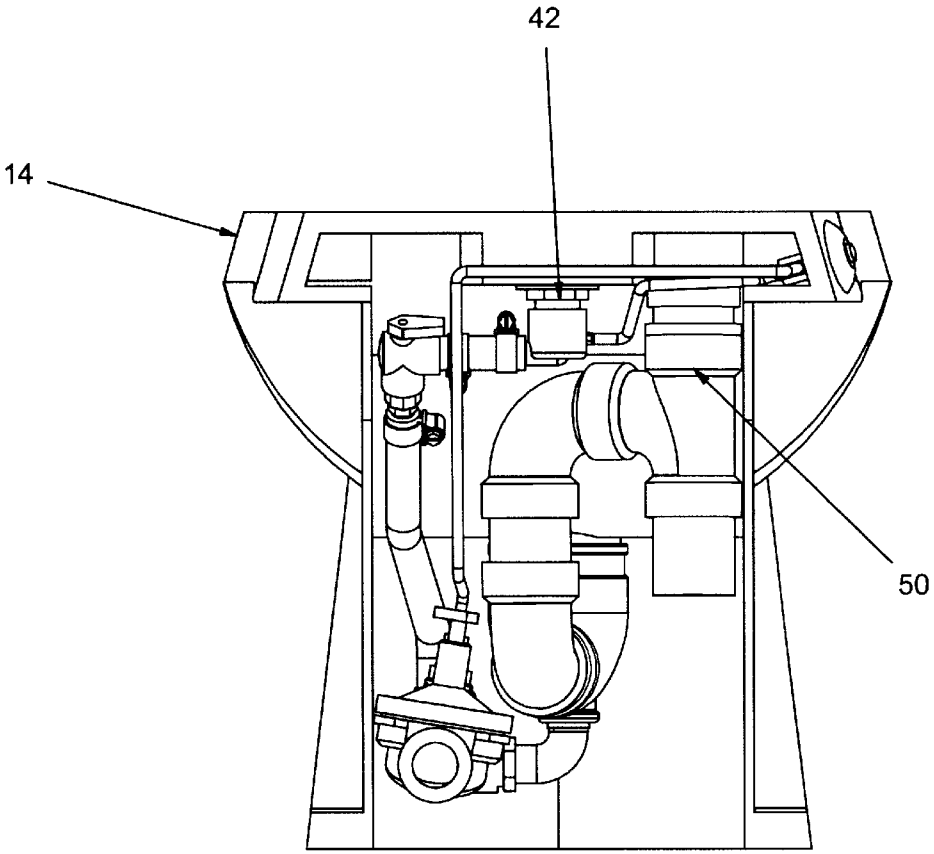
FIG. 5 shows an end view of the invention.
Figure 6:
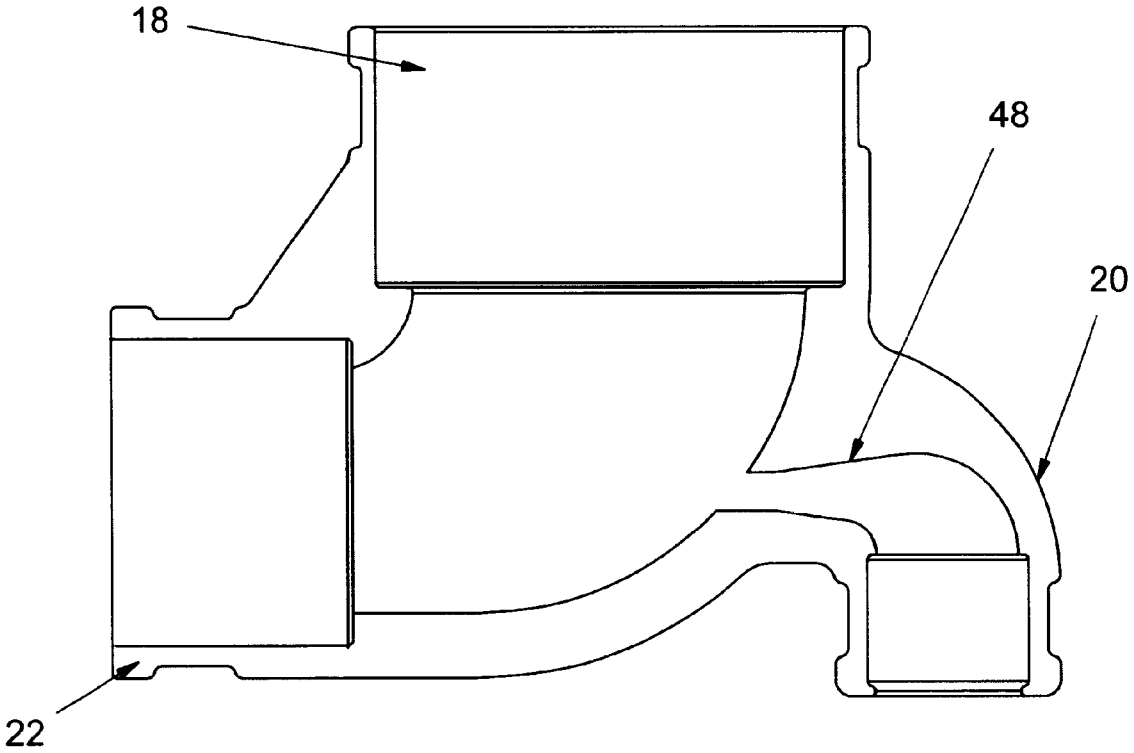
FIG. 6 shows the nozzle used in the water jet macerator of the invention.

Also shown in FIG. 3, and FIG. 5, is an anti-siphon device (50), which in the most preferred embodiment is as a vented loop. The vented loop (50) is connected to the first discharge passageway, and to a second passageway (52) (shown in FIG. 2 and FIG. 3), which is preferably sanitation piping. In the vented loop embodiment, the vented loop further consists of valve means, which permits air to enter the vented loop. Other anti-siphon devices, which would work within the scope of this invention, include vented sanitary T structures 100 as shown in FIG. 1.

In another embodiment of this invention, this toilet operates without a tank top, which is a significant space saving feature for maritime, aircraft, and recreational vehicle use. It is contemplated that this invention will be usable for recreational vehicles and modular portable housing as well as for residential and commercial buildings.

The toilet has a unique integrated flush valve, which enables a jet water passageway diameter of $\frac{3}{16}$+/−$\frac{1}{16}$ ID to work with a discharge sanitary pipe inner diameter ratio of about 1.5. The ratio between these diameters is extremely efficient. The maximum efficiency is realized at a ratio of 0.125/1 or $\frac{3}{16}^{th}$ inch jet firing into a 1.5-inch waste pipe.

The toilet, in the preferred embodiment, has as the anti-siphon device an integrated siphon break which makes the toilet system more powerful and more effective and more efficient with the use of less than one gallon of water per flush.

In the most preferred embodiment, the siphon break is a vented loop. The waste piping must be pitched downward after the vented loop, at a minimum grade of 1% In this invention, at the end of each flush cycle, as wastewater is traveling downhill on both sides of the vented loop, it applies vacuum to the upstream sanitation piping. The vented loop has a check valve that opens when this vacuum is applied and allows air to enter the discharge piping. This vented loop allows wastewater beyond this point to travel to tanks or other collection points without siphoning the remaining water from the bowl. The check valve closes upon release of vacuum and does not permit the escape of gases. The vented loop does not allow air from the discharge piping to vent into the bowl of the toilet like a typical household toilet. Further, it facilitates the elimination of outside ventilation of the wastewater piping which is common with household toilets. This makes installation of wastewater piping faster, less complicated and ultimately less costly.

In another embodiment, the toilet operates with an internal non-electric flush valve. This valve additionally saves space and installation time, making this toilet much cheaper to install than existing commercial toilets.

In still another embodiment, the toilet has an actuator, which is a trip valve and an inlet diaphragm valve.

In still another embodiment, the toilet can discharge through the floor under the toilet bowl, or through a wall behind the toilet facilitating flexibility in the installation, and reducing costs to modify the user's structures for toilet installation.

Another embodiment of the invention involves a toilet, which is capable of vertically discharging waste up to three (3) feet, before proceeding over a vented loop.

In still another embodiment of this invention, the toilet does not require a roof vent, which in the trade is known as a stack vent, which usually required on most commercial toilets currently available. This is particularly advantageous for situations where the toilet must be in a contained environment, such as a submarine, where no roof vent is possible or in containerized quarters, which permit stacking.

The invention is design to advantageously use only between 1 gallon and 0.75 gallons of water per flush, most preferably 0.875 gallons per flush.

In a preferred embodiment, the inlet valve is made of ABS plastic or rubber. The actuator is preferably made of nickel-plated brass. The water jet macerator is preferably made of cast urethane. The anti-siphon device, or vented loop is preferably made of PVC or silicone rubber or combinations thereof. Other tubes and hoses usable in this invention are contemplated to be made from a member of the group: plastic, polyethylene, urethane and combinations thereof.

Figure 7:
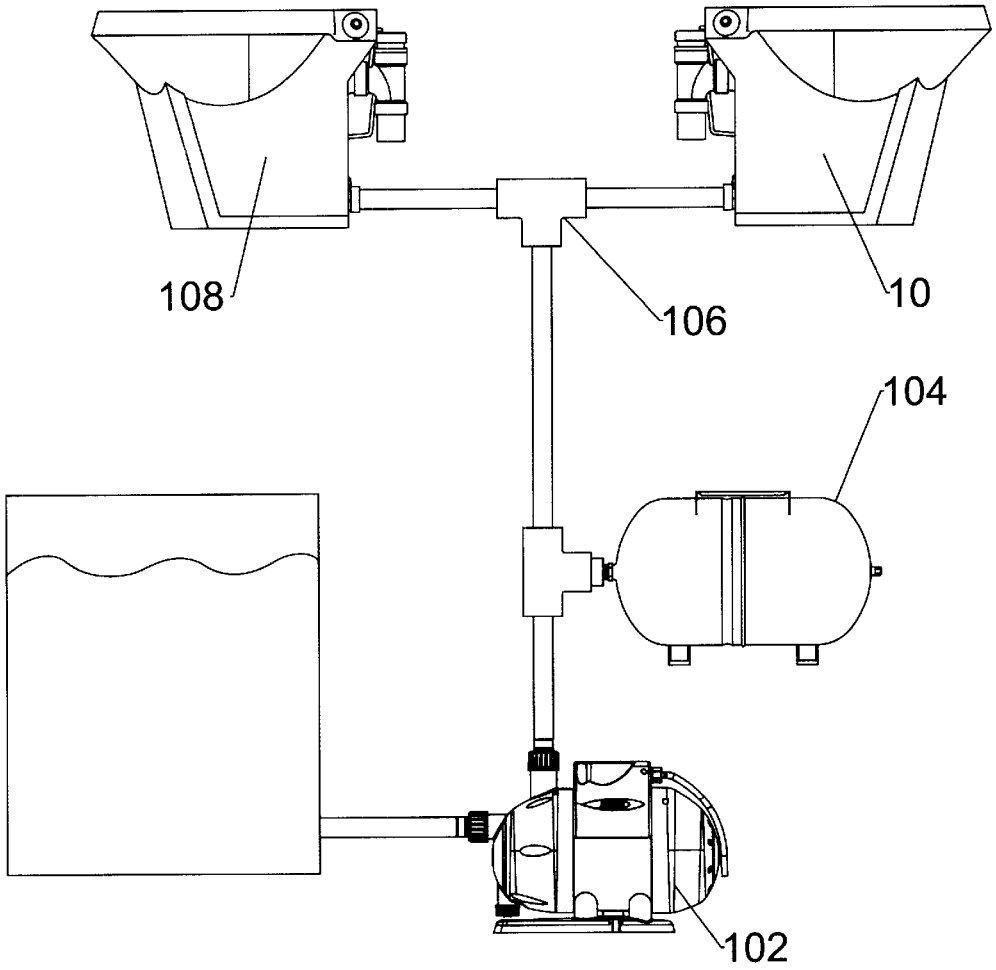
FIG. 7 shows multiple toilets of the invention connected together in a system.

In addition to the single toilet, the invention relates to a system which utilizes several of these unique toilets, a first toilet 10 and a second toilet 108 connected to [with] a central system as shown in FIG. 7 wherein the water comes from a central source using a central system pump 102, a pressure accumulation tank 104 and a distribution manifold 106.

The invention also relates to a method for disposing of human waste using less than 1 gallon of water, comprising: depressing an actuator to start flushing a toilet body having bowl, a water jet macerator, and a rim; releasing water from an inlet valve and creating a pressure drop in said valve; splitting the released water into two streams, a first water stream and a second water stream, and flowing the first water stream into a tapered nozzle fitted into an opening in said water jet macerator, and flowing the second water stream to a rim valve which releases water to the rim of the toilet body; expelling water through a nozzle horizontally across the bottom of the bowl into a discharge inlet, forming a vacuum that pulls waste from the bowl, macerates the waste and passes the macerated waste into a first discharge passageway.

Further features and advantages of the invention will be apparent from the specification and the drawing. While the present invention has been described with reference to the details of the embodiments of the invention shown in the drawing, these details are not intended to limit the scope of the invention as claimed in the appended claims.

PARTS LIST

Toilet Body 10
Bowl 12
Support Walls 13
Rim 14
Waste Outlet 15
Water jet macerator 16
Waste Inlet 18
Macerator Water Inlet 20
Discharge opening 22
First Discharge Passageway 26
Water inlet port 30
Water source 32
Inlet valve 34 (diaphragm)
Splitter 36
First water stream 38
Second water stream 40
Bowl spud 42
Hydraulic actuator 44
Rim valve 46
Nozzle 48
Antisiphon device 50
Second sanitation piping 52
Flow regulator 54
Vented loop valve means 56
Monitoring system 58
Central system Water supply pump
Pressure accumulator tank
Distribution manifold
Base coupling

What is claimed is:

1. A toilet with a flush volume of less than 1 gallon, comprising:

a. a toilet body comprising a bowl, support walls, a rim, and a waste outlet;

b. a water jet macerator, having a waste inlet connected to said waste outlet a macerator water inlet connected to a second water stream and a discharge opening connected to a first discharge passageway;

c. said toilet body further comprising a water inlet port for receiving water from a water source connected to an inlet valve;

d. a splitter for dividing water from the inlet valve into a first water stream and a second water stream;

e. rim valve for receiving water from said first water stream;

f. a bowl spud for receiving water from rim valve;

g. rim adapted to receives water from bowl spud;

h. an actuator connected to inlet valve which permits a user to initiate flushing by actuating inlet valve causing water to flow to splitter, second water stream and first water stream; stream across bowl into discharge opening macerating the waste and moving i. a nozzle for receiving second water stream and expelling water from second water macerated waste into first discharge passageway wherein the volume of said expelled water in said first discharge passageway is less than 1 gallon, and j. an anti-siphon device connected to the first discharge passageway and to second discharge passageway.

2. The toilet of claim 1, wherein the inlet valve is selected from the group: diaphram valves, piston valves, ball valves, hydraulic valves and pinch valves.

3. The toilet of claim 1, wherein said actuator is selected from the group: hydraulic valves, electric valves, pneumatic valves and mechanical valves.

4. The toilet of claim 1, wherein said nozzle is tapered.

5. The toilet of claim 1, wherein said inlet valve comprises a diaphragm valve with a flow regulator, and said flow regulator has a diameter ranging from 0.01 inches to 0.12 inches.

6. The toilet of claim 1, wherein said nozzle has an inner diameter between ⅛th inch and ¾ inches.

7. The toilet of claim 1, wherein the nozzle has an inner diameter that ranges from ⅛ to ¾ inches concurrent with the diameter of the first discharge passageway that ranges from 1.25 to 2.0 inches in diameter.

8. The toilet of claim 1, wherein the anti-siphon device is a vented loop which comprising a vented loop valve means that permits air to enter the vented loop.

9. The toilet of claim 1, wherein the anti-siphon device is a vented sanitary T.

10. The toilet of claim 1, wherein the water source is pressurized water.

11. The toilet of claim 10, wherein the water is pressurized to at least 25 psi.

12. The toilet of claim 4, wherein said tapered nozzle expels water at a rate of between 8 and 16 gallons per minute.

13. The toilet of claim 1, wherein said toilet is adapted for use in marine use for a production platform that is of a member of the group: a deep draft cassion vessel (SPAR), a tension leg platform (TLP), a semisubmersible production vessel, a fixed leg production platform and a compliant tower production platform, and for boats, and other floating vessels.

14. The toilet of claim 1, wherein said toilet is adapted for use in modular portable housing.

15. The toilet of claim 1, wherein said toilet is adapted for use in recreation vehicles.

16. The toilet of claim 1, wherein said toilet is adapted for use in aircraft.

17. The toilet of claim 1, wherein said toilet is adapted for use in residential and commercial buildings.

18. The toilet of claim 1, wherein said toilet body is made from a member of the group: porcelain, metal and composites.

19. The toilet of claim 1, wherein said toilet body is a one-piece integral construction.

20. A method for disposing of human waste using less than 1 gallon of water, comprising:

a. depressing an actuator to start flushing a toilet body comprising a bowl, a water jet macerator, and a rim;

b. releasing water from an inlet valve and creating a pressure drop in said inlet valve;

c. splitting the released water into two streams, a first water stream and a second water stream, and flowing the first water stream into a nozzle fitted into an opening in said water jet macerator, and flowing the second water stream to a rim valve which releases water to the rim of the toilet body;

d. expelling water through the nozzle horizontally across the bottom of the bowl into a discharge opening, forming a vacuum that pulls waste from the bowl, macerates the waste and passes the macerated waste into a first discharge passageway wherein the volume of said expelled water in said first discharge passageway is less than 1 gallon; and e. using an anti-siphon device to prevent fluid from flowing out of the bowl after flushing.

21. A toilet system comprising:

a. a plurality of toilets, each toilet with a flush volume of less than 1 gallon, comprising:

b. a toilet body comprising a bowl, support walls, a rim, and a waste outlet;

c. a water jet macerator having a waste inlet connected to said waste outlet, a macerator water inlet connected to a second water stream and a discharge opening connected to a first discharge passageway;

d. said toilet body further comprising a water inlet port for receiving water from a water source connected to an inlet valve;

e. a splitter for dividing water from the inlet valve into a first water stream and a second water stream;

f. rim valve for receiving water from said first water stream;

g. a bowl spud for receiving water from rim valve;

h. rim adapted to receives water from bowl spud;

i. an actuator connected to inlet valve which permits a user to initiate flushing by actuating inlet valve causing water to flow to splitter, second water stream and first water stream;

j. a nozzle for receiving second water stream and expelling water from second water stream across bowl into discharge opening macerating the waste and moving macerated waste into first discharge passageway wherein the volume of said expelled water in said first discharge passageway is less than 1 gallon; and k. an anti-siphon device connected to the first discharge passageway and to a second discharge passageway;

l. a central system pump;

m. a pressure accumulation tank connected to the central system pump for providing pressurized water; and n. a distribution manifold for receiving pressurized water from the pressure accumulation tank and distributing the pressurized water to said plurality of toilets.

* * * * *